United States Patent [19]

Skyba

[11] Patent Number: 4,729,363

[45] Date of Patent: Mar. 8, 1988

[54] ARCHER'S BOW REST FOR TREE STAND

[76] Inventor: Helmut K. Skyba, Rte. 2, Box 330, Wild Rose, Wis. 54984

[21] Appl. No.: 911,522

[22] Filed: Sep. 25, 1986

[51] Int. Cl.[4] ..... F16M 11/00

[52] U.S. Cl. ..... 124/23 R; 248/309.1; 211/13

[58] Field of Search ..... 124/23 R, 24 R, DIG. 1; 248/309.1; 211/13; 403/119, 54, 107

[56] References Cited

U.S. PATENT DOCUMENTS

| | | | |
|---|---|---|---|
| 404,020 | 5/1889 | Sprague | 403/107 |
| 2,206,560 | 7/1940 | Embury | 248/309.1 |
| 3,780,971 | 12/1973 | De Filipps | 248/309.1 |
| 4,331,311 | 5/1982 | Russell | 124/23 R |
| 4,356,922 | 11/1982 | Dierksheide | 211/13 |
| 4,360,179 | 11/1982 | Roberts | 124/23 R |
| 4,474,296 | 10/1984 | Hartman | 124/23 R |

*Primary Examiner*—Randolph A. Reese
*Assistant Examiner*—Peter M. Cuomo
*Attorney, Agent, or Firm*—Fuller, Puerner & Hohenfeldt

[57] ABSTRACT

A bow stand enables a hunter standing on a tree stand to temporarily store the bow in a generally vertical attitude. The bow stand includes first and second U-shaped brackets mounted to the tree stand platform. Both brackets are pivotable between folded configurations in facing contact with the platform and open configurations. In the open configurations, the first bracket lies parallel to the platform and overhangs the front edge, and the second bracket lies in a generally vertical plane below the first bracket. The brackets are shaped to receive a bow inserted vertically through both brackets and to hold the bow in place on the platform.

16 Claims, 3 Drawing Figures

ARCHER'S BOW REST FOR TREE STAND

BACKGROUND OF THE INVENTION

1. Field of the Invention

This invention pertains to hunting equipment, and more particularly to apparatus for storing bows.

2. Description of the Prior Art

Numerous products have been developed that increase a hunter's chances of success in the field. For example, it is well known that hunters employ tree stands from which they can observe game in the area. Conventional tree stands pose a problem for bow hunters. The bows are relatively long and rather cumbersome to maneuver on a tree stand. The relatively small size of the tree stand platform does not provide adequate space for laying the bow down when the hunter wants to rest. Merely leaning the bow against the tree trunk is unacceptable because of the probability that it will slip and fall to the ground below. Further, the movements associated with picking up the bow and maneuvering it into position when game comes into view are likely to scare the animal back into the brush.

Thus, a need exists for equipment that facilitates bow handling in a tree stand.

SUMMARY OF THE INVENTION

In accordance with the present invention, a compact and convenient bow stand is provided that greatly eases a hunter's problems associated with handling a bow in a tree stand. This is accomplished by apparatus that includes a sturdy platform in combination with a pair of swingable brackets designed to releasably hold a bow in an upright position.

The platform may be of generally conventional construction, and it may be secured to the tree in any suitable manner. The first bracket is composed of a heavy wire or rod bent into a generally U-shape. The free ends of the bracket are inturned and are pivotally retained within suitable plates attached to the top of the platform several inches from the platform front edge. The first bracket is thus capable of being swung in an arc of 180° between a folded configuration in facing contact with the platform and an open configuration parallel with the platform and overhanging the platform front edge. The bracket loop end has a channel shaped section that loosely guides the bow frame.

The second swingable bracket is pivotally mounted adjacent the platform front edge. The second bracket is formed from a length of heavy wire or rod into a cruciform outline defined by three channels and a pair of free legs. The ends of the two legs are pivotally received in the plates used to mount the first bracket. The pivot points of the second bracket legs overhang the platform front edge. The second bracket can thus be swung in an arc of about 260° between a folded configuration overlying the platform and an open downwardly hanging attitude of approximately 80° to the platform. With both brackets unfolded, the first bracket lies in a horizontal plane above the second bracket.

In use, the bow lower end is vertically inserted through the open first bracket, and then into the second bracket. The three channels of the second bracket have a size and shape to permit vertically inserting the bow lower end, including a bow pulley, through the bracket when it is in the open configuration. The bow is tilted forward such that the frame thereof contacts the channel section of the first bracket and the bow center of gravity is outside of the first bracket. The second bracket is designed such that the opposed channel shoulders adjacent the bracket legs provide reaction points for the bow lower end to restrain further tilting of the bow. In that manner, gravity retains the bow nearly upright in place within the two brackets. After use, the two brackets are folded to an unobtrusive position within the outline of and against the platform. The bow stand of the present invention may then be carried and stored as conveniently as a conventional tree stand.

Other objects, aims, and advantages of the invention will become apparent upon reading the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
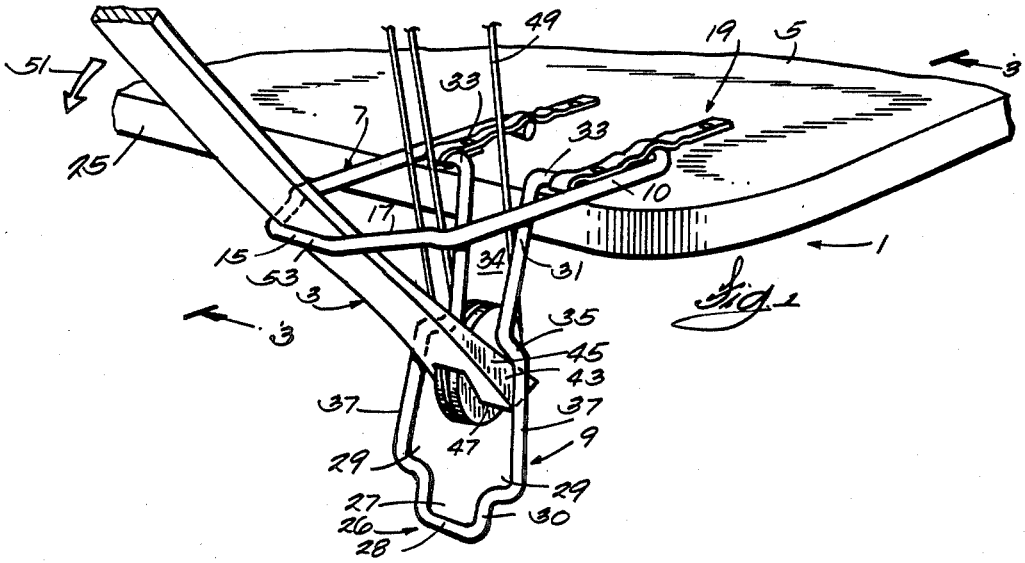
FIG. 1 is a perspective view of the bow stand of the present invention in use to support a bow.
Figure 2:
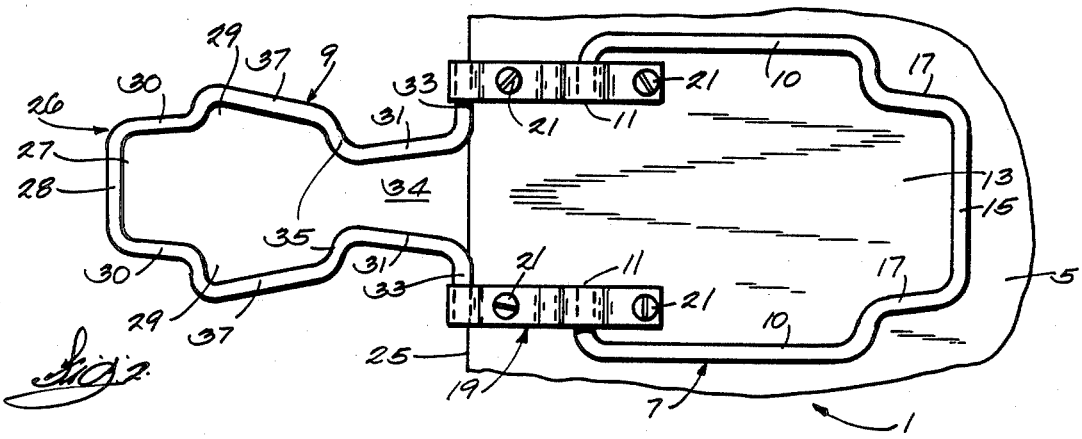
FIG. 2 is a top view of the bow stand shown in a partially opened configuration.
Figure 3:
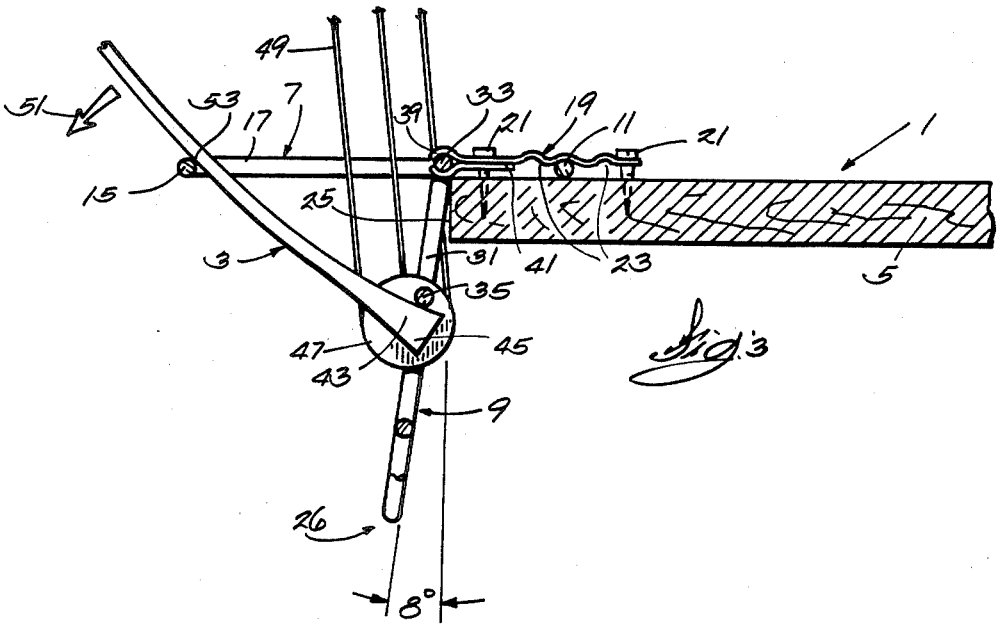
FIG. 3 is a cross-sectional view taken along lines 3—3 of FIG. 1.

Referring to FIGS. 1–3, a bow stand 1 is illustrated that includes the present invention. The bow stand is particularly useful to bow hunters for holding a bow 3 upright in a tree stand, but it will understood that the invention is not limited to hunting applications.

The bow stand 1 includes a platform 5 that may be secured to a tree, not shown, in any suitable manner. The platform 5 may be made of plywood or similar material and is strong enough to support a person, as is known in the art.

In accordance with the present invention, the bow stand 1 includes a first pivotable bracket 7 and a second pivotable bracket 9. The first bracket 7 is formed from a heavy rod or wire into a generally U-shape. The legs 10 of the bracket terminate in inturned ends 11. The bracket loop end distal from the leg ends 11 is preferably bent so as to create a channel section 13. For that purpose, the bracket is bent with a loop end section 15 bound by side sections 17.

To permit the bracket 7 to pivot in a vertical plane with respect to the platform 5, the inturned ends 11 are mounted to the platform by means of a pair of curved plates 19. The plates 19 are fastened to the platform by conventional screws 21. As best seen in FIGS. 1 and 3, the plates are formed with one or more concave recesses 23 having radii to accept the bracket ends. The location of the ends in the plate recesses 23 is several inches from the platform front edge 25. Consequently, the first bracket is pivotable between the folded configuration shown in FIG. 2 wherein the bracket lies entirely in facing contact with the platform and within the outline of the platform, and the open configuration of FIGS. 1 and 3, wherein the first bracket lies parallel to the platform but overhangs the platform front edge 25.

In the preferred embodiment, the second bracket 9 is fabricated from a heavy wire into a loop end 26 and a pair of legs 31. The loop end 26 is bent so as to define an end channel 27 and a pair of opposed side channels 29.

The channel 27 is defined by an end section 28 and side sections 30. The side channels 29 connect by means of transverse shoulders 35 to a pair of legs 31 having outturned ends 33. The legs 31 straddle an open throat area 34.

To permit the second bracket 9 to pivot with respect to the platform 5, the leg ends 33 are mounted in recesses 39 in the ends of the plates 19, and the ends are held in place by small clips 41. In the illustrated construction, the recesses 39 and clips 41 overhang the platform front edge 25 by a small amount. Accordingly, the second bracket is capable of pivoting to a folded configuration in facing contact with the platform. In the folded configuration the second bracket 9 nests inside the first bracket 7 when the first bracket 7 is also in the folded configuration of FIG. 2. The location of the recesses 39 and clips 41 are chosen such that the second bracket 9 is capable of rotation through approximately 260° to a generally vertical attitude, as shown in FIGS. 1 and 3. Preferably, the unfolded second bracket 9 makes an angle of approximately 6 to 10 degrees with the vertical. The bow stand 1 is most conveniently carried and stored when the brackets 7 and 9 are in the folded configuration.

To use the bow stand 1 of the present invention, the bow hunter mounts the leg ends 11 of the bracket 7 in the particular plate recesses 23 that best suit his bow size. He then transports the bow stand, preferably with the brackets 7 and 9 lying within the platform outline 5 in the folded configuration, to the selected tree. The hunter secures the platform 5 to the tree in the manner appropriate for the particular platform. While he is standing on the platform looking for game, the hunter may choose to leave the brackets 7 and 9 in the folded configuration, or he may open them to the configuration of FIGS. 1 and 3. The brackets 7 and 9 must be unfolded when it is desired to temporarily store the bow 3. The hunter inserts the lower end of the bow frame 43 vertically through the opening of the first bracket 7 and then through the channels 27 and 29 of the second bracket 9. The three-channel design of the second bracket 9 allows the bow frame lower end 45 and pulley 47 to pass vertically through the channels 27 and 29, and the bow strings 49 pass through the throat 34. If desired, the hunter may slide the bow 3 along the first bracket channel section 15. To steadily hold the bow 3 in the bow stand, the bow is tilted forward slightly in the direction of arrow 51, such that the bow center of gravity lies outside the first bracket 7, and the bow frame at point 53 rests against the channel section 15. The several recesses 23 in the plates 19 permit adjusting the location of the channel section 15 to accommodate different bow sizes. The bow lower end 45 tends to tilt upwardly with respect to FIGS. 1 and 3 about the contact point 53 between the bow frame 43 and the channel section 15. After a slight amount of tilting, the bow frame lower end 45 contacts the second bracket shoulders 35. The shoulders 35 form reaction points to prevent further tilting, and thus hold the bow 3 in a generally upright attitude.

The distance between the side sections 17 of the first bracket 7 is designed to loosely guide the sections 15 and 17 and the shoulders 35 of the second bracket 7 may be covered with soft sleeves. (Not shown) Alternately, the entire brackets 7 and 9 may be coated with a protective material such as soft vinyl approximately 0.08 inches thick.

The bow 3 is quickly and easily removed from the bow stand 1 with minimum motions to disturb nearby game. Removal is accomplished merely by pushing the bow 3 downwardly slightly along the first bracket channel section 15, tilting the bow 3 backward in the opposite direction of arrow 51, and pulling it vertically upwardly through the two brackets 7 and 9. After the day's hunt, the brackets 7 and 9 are folded against the platform 5 for convenient carrying from the woods.

Thus, it is apparent that there has been provided, in accordance with the present invention, a bow stand that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A bow stand comprising:

a. a generally horizontal platform having a front edge and a top surface;

b. a generally U-shaped first bracket having a loop end and a pair of leg ends pivotally mounted to the platform top surface to permit pivoting the first bracket between a folded configuration in facing contact with the platform top surface and an open configuration wherein the first bracket lies in a plane parallel to the platform and overhanging the platform front edge; and c. a generally U-shaped second bracket having a pair of opposed generally transverse shoulders and a pair of leg ends pivotally mounted to the platform top surface for pivoting between a folded configuration in facing contact with the platform top surface and an open configuration wherein the second bracket lies in a generally vertical plane below the first bracket, the first and second brackets being configured to receive a bow inserted vertically through the brackets with the first bracket contacting a first point on the bow frame to support it against gravity and the second bracket shoulders providing reaction points for a second point on the bow frame to prevent tilting about the contact point between the bow and the first bracket, so that the brackets cooperate to steadily hold the bow in a generally upright attitude.

2. The bow stand of claim 1 wherein the loop end of the first bracket is formed with a channel section adapted to loosely guide the bow.

3. The bow stand of claim 1 wherein the second bracket is formed with a generally cruciform outline having an end channel and two opposed side channels, the end and side channels being adapted to receive the bow frame lower end and a bow pulley.

4. The bow stand of claim 3 wherein the second bracket shoulders are located between the respective side channels and the legs, and wherein the legs straddle an open throat area adapted to receive the bow strings when the bow is inserted vertically through the brackets.

5. The bow stand of claim 1 wherein the first bracket lies within the platform outline when in the folded configuration, and wherein the second bracket nests inside the first bracket when the brackets are in the folded configuration.

6. The bow stand of claim 1 wherein the second bracket makes an angle of about 6 to 10 degrees with the vertical when in an unfolded configuration.

7. Apparatus for holding a bow in a generally vertical attitude comprising:

a. a generally horizontal platform having a front edge and top surface;

b. a first generally U-shaped bracket having a loop end and a pair of legs;

c. mounting means for pivotally securing the first bracket legs to the platform top surface to enable the first bracket to pivot between a folded configuration wherein the first bracket is in facing contact against the platform and an open configuration wherein the first bracket lies in a plane parallel to the platform and overhanging the platform front edge;

d. a second generally U-shaped bracket having a loop end and a pair of legs, the loop end defining a pair of opposed transverse shoulders adjoining respective legs; and e. mounting means for pivotally mounting the second bracket legs to the platform top surface to permit pivoting the second bracket between a folded configuration in facing contact with the platform and an open configuration wherein the second bracket lies in a generally vertical plane under the first bracket, the loop end of the first bracket and the shoulders of the second bracket cooperating to hold a bow inserted vertically through the brackets in a generally vertical attitude.

8. The apparatus of claim 7 wherein the loop end of the first bracket is formed with a channel section adapted to contact and loosely guide the bow.

9. The apparatus of claim 8 wherein the second bracket loop end is formed with an end channel and a pair of opposed side channels partially defined by the transverse shoulders, the end and side channels being adapted to receive the bow lower end, so that the bow may be tilted forwardly to contact the first bracket channel section and the second bracket shoulders provide reaction points to limit, the forward tilting and thereby hold the bow in place.

10. The apparatus of claim 7 wherein the first bracket lies entirely within the outline of the platform when the first bracket is in the folded configuration, and wherein the second bracket nests within the first bracket when the first and second brackets are in the folded configuration.

11. The apparatus of claim 7 wherein the second bracket legs are spaced apart to define an open throat area for receiving the bow strings when the bow is inserted through the second bracket.

12. The apparatus of claim 7 wherein the second bracket and the means for pivotally mounting the second bracket to the platform cooperate to maintain the second bracket in a plane making an angle of approximately 6 to 10 degrees with the vertical when the second bracket is in the open configuration.

13. The apparatus of claim 7 wherein the mounting means for pivotally securing the first bracket legs to the platform comprise plates having a plurality of recesses for receiving the leg ends, the recesses being located at predetermined spaced distances from the platform free edge, so that the location of the loop end of the first bracket in the opened configuration may be adjusted to accommodate different size bows.

14. A method of storing a bow comprising the steps of:

a. providing a generally horizontal platform having generally U-shaped first and second brackets pivotally mounted to the platform, the first bracket being pivotable between a folded configuration in facing contact with the platform and an open configuration parallel to and overhanging the platform, the second bracket being pivotable between a folded configuration in facing contact with the platform and an open configuration approximately perpendicular to the platform and below the first bracket;

b. pivoting the first and second brackets to their respective open configurations;

c. vertically inserting a bow through the first and second brackets;

d. tilting the bow forwardly to contact the first bracket and to place the bow center of gravity outside of the first bracket; and e. tilting the bow forwardly to contact the bow lower end with the second bracket, so that the second bracket provides reaction points to prevent further bow tilting and thereby cooperate with the first bracket to hold the bow in a generally vertical attitude.

15. The method of claim 14 wherein the step of providing a platform with first and second brackets includes the step of providing the first bracket with a channel to loosely guide the bow held in the first and second brackets.

16. The apparatus of claim 15 wherein the step of vertically inserting the bow through the first and second brackets includes the step of vertically sliding the bow along the first bracket channel.

* * * * *